US006581501B2

(12) United States Patent
McGrath

(10) Patent No.: US 6,581,501 B2
(45) Date of Patent: Jun. 24, 2003

(54) DEVICE FOR USE IN PREPARATION OF ANIMATION PAPER

(76) Inventor: Paul McGrath, 20 Huntstown Ct., Mulhuddart, Dublin 15 (IE)

( * ) Notice: Subject to any disclaimer, the term of this patent is extended or adjusted under 35 U.S.C. 154(b) by 0 days.

(21) Appl. No.: 09/899,800

(22) Filed: Jul. 5, 2001

(65) Prior Publication Data

US 2002/0002890 A1 Jan. 10, 2002

(30) Foreign Application Priority Data

Jul. 5, 2000 (IE) ..... S2000/0537

(51) Int. Cl.[7] ..... B26F 1/14

(52) U.S. Cl. ..... 83/467.1; 83/687; 83/599; 269/303

(58) Field of Search ..... 83/599, 663, 588, 83/440.1, 669–670, 620, 687, 467.1–468.94; 269/303–305

(56) References Cited

U.S. PATENT DOCUMENTS

| | | | | | |
|---|---|---|---|---|---|
| 680,599 | A | * | 8/1901 | Jones et al. | 83/620 |
| 1,023,715 | A | * | 4/1912 | Bristol | 402/79 |
| 1,443,092 | A | * | 1/1923 | Pettis | 402/79 |
| 1,911,398 | A | * | 5/1933 | Schade | 402/80 L |
| 2,558,567 | A | * | 6/1951 | Kaeser | 83/589 |
| 3,172,325 | A | * | 3/1965 | Wernham et al. | 83/599 |
| 3,349,774 | A | * | 10/1967 | Ryan | D19/27 |
| 3,760,506 | A | * | 9/1973 | Tudberry | 33/1 BB |
| 3,975,105 | A | * | 8/1976 | Cline | 30/358 |
| 4,713,995 | A | * | 12/1987 | Davi | 83/167 |
| 4,941,381 | A | * | 7/1990 | Garner | 83/599 |
| 5,005,458 | A | * | 4/1991 | Merrick | 83/599 |
| 5,273,387 | A | * | 12/1993 | Groswith et al. | 412/38 |
| 5,291,813 | A | * | 3/1994 | Blumenthal et al. | 83/599 |
| 5,291,814 | A | * | 3/1994 | Fierkens | 83/55 |
| 5,340,229 | A | * | 8/1994 | Schwartzman | 83/620 X |
| 5,409,319 | A | * | 4/1995 | Bedol | 30/123 X |
| 5,490,440 | A | | 2/1996 | Karlis et al. | |
| 5,553,958 | A | * | 9/1996 | Bedol | 402/1 |
| 5,638,730 | A | * | 6/1997 | Karlis | 83/167 |
| D396,245 | S | * | 7/1998 | Ng | D19/72 |
| D397,359 | S | * | 8/1998 | Bedol et al. | D19/72 |
| 5,906,448 | A | * | 5/1999 | Najmi | 402/1 |
| 5,967,786 | A | * | 10/1999 | Wang | 83/620 |
| 6,261,020 | B1 | * | 7/2001 | Wyant | 83/167 |
| 6,439,093 | B1 | * | 8/2002 | Davies | 83/687 |

FOREIGN PATENT DOCUMENTS

| | | |
|---|---|---|
| DE | 33 39 742 A1 | 5/1985 |
| DE | 42 08 414 C2 | 9/1993 |
| DE | 201 07 342 U1 | 10/2001 |
| GB | 2 209 133 A | 5/1989 |

* cited by examiner

*Primary Examiner*—Allan N. Shoap
*Assistant Examiner*—Jason Prone
(74) *Attorney, Agent, or Firm*—Hoffmann & Baron, LLP

(57) ABSTRACT

A device for use in preparation of animation paper has a punching plate connected to a receiving plate by hinges. The punching plate has an upwardly extending circular punch located intermediate and coaxial with two upwardly extending rectangular punches and four alignment receiving apertures. The receiving plate in turn has a circular recess located intermediate and coaxial with two rectangular recesses and four upwardly extending paper guides. The receiving plate also has a dimension guide.

9 Claims, 6 Drawing Sheets

DEVICE FOR USE IN PREPARATION OF ANIMATION PAPER

BACKGROUND OF THE INVENTION

The present invention relates to a device and more particularly to a punch device for use in preparation of animation paper.

An animation shot is composed of a series of individual animation sheets laid one on top of another, with each animation sheet having a component of the overall image. To ensure that successive layers of the animation sheets are held in registration, a series of holes are punched in each sheet and these holes are aligned. The tolerances between the size of the holes and the size of retaining pegs on a cell holder are tight to ensure that there is no movement between layers. The risk of relative movement between layers is further minimised by the nature of the holes themselves, which are generally of the format rectangular-circular-rectangular, with the rectangular holes located at a preset distance from the centre circular hole. The term rectangular used in this specification is used to describe an elongated slot with semi-circular ends.

Pre-punched animation paper is relatively expensive and thus, many animators prefer to punch their own paper to reduce costs. To do this the animators and student animators must purchase or gain access to a specialised punch. The size and costs such animation paper punches means that they are not widely available. This can prove particularly problematic where an animator underestimates the number of sheets required and there is difficulty obtaining the additional sheets required.

There is therefore a need for a device, which will overcome the aforementioned problems.

SUMMARY OF THE INVENTION

Accordingly, there is provided a device for use in preparation of animation paper, the device having a punching plate hingedly connected to a receiving plate.

Preferably, the punching plate has an upwardly extending circular punch intermediate and coaxial with two upwardly extending rectangular punches.

In one arrangement, the punching plate defines an alignment receiving aperture.

Ideally, the receiving plate defines a circular recess located intermediate and coaxial with two rectangular recesses.

In one arrangement, the receiving plate incorporates an upwardly extending paper guide formed for complimentary engagement with an aperture on the punching plate.

In one embodiment of the invention the receiving plate incorporates a dimension guide.

In a particularly preferred arrangement, the or each rectangular punch has an angled cutting edge. This prevents undue contact between the punching plate and the receiving plate and allows tighter tolerances to be achieved thereby guaranteeing registration between respective sheets of a given cell animation page.

Preferably, the or each paper guide has an abutment edge and an angled top profile.

BRIEF DESCRIPTION OF THE DRAWINGS

The invention will now be described with reference to the accompanying drawings, which show, by way of example only, one embodiment of a device in which.

DETAILED DESCRIPTION

Figure 1:
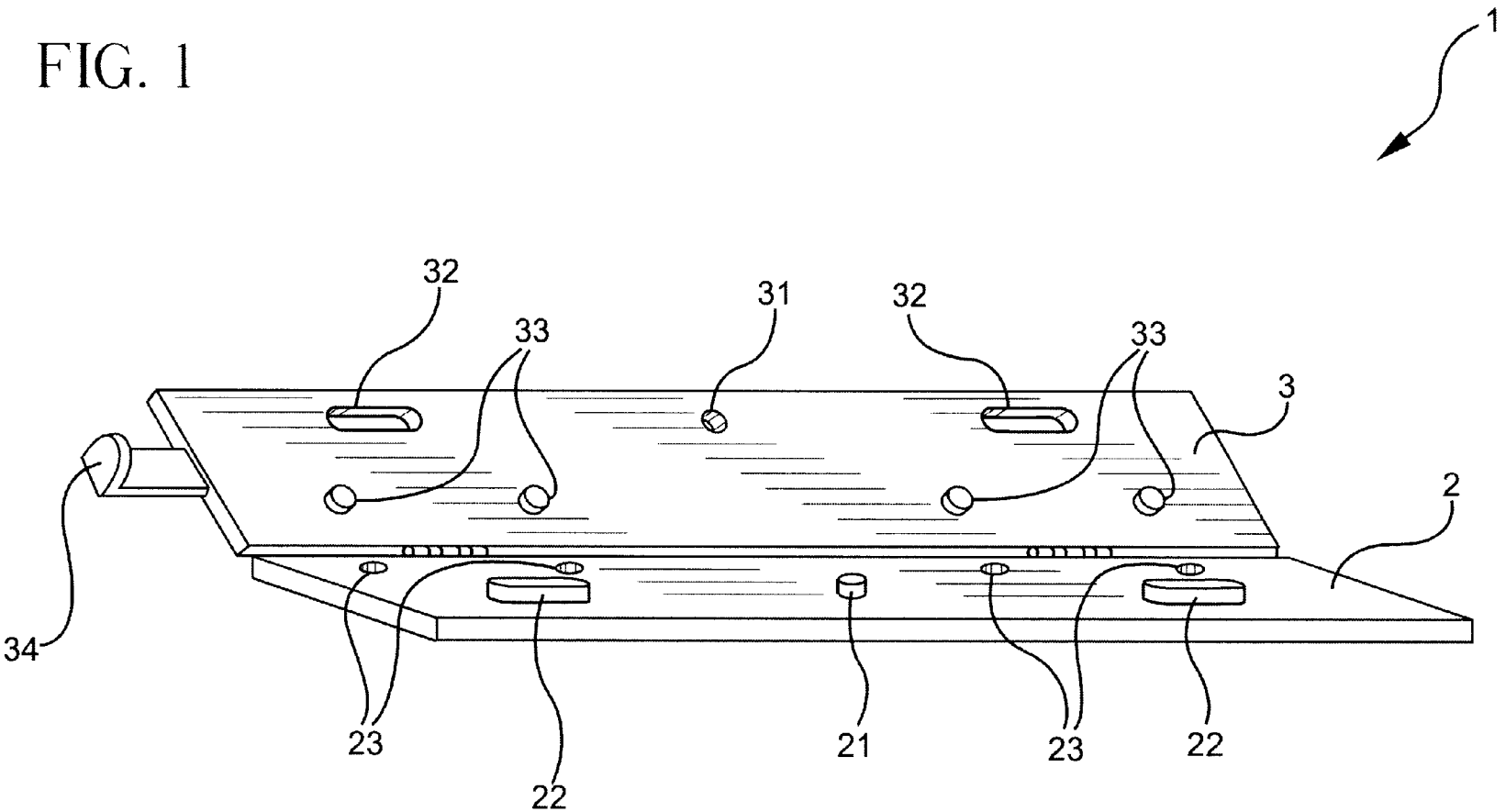
FIG. 1 is a perspective view of a first embodiment of a device in accordance with the invention.
Figure 2:
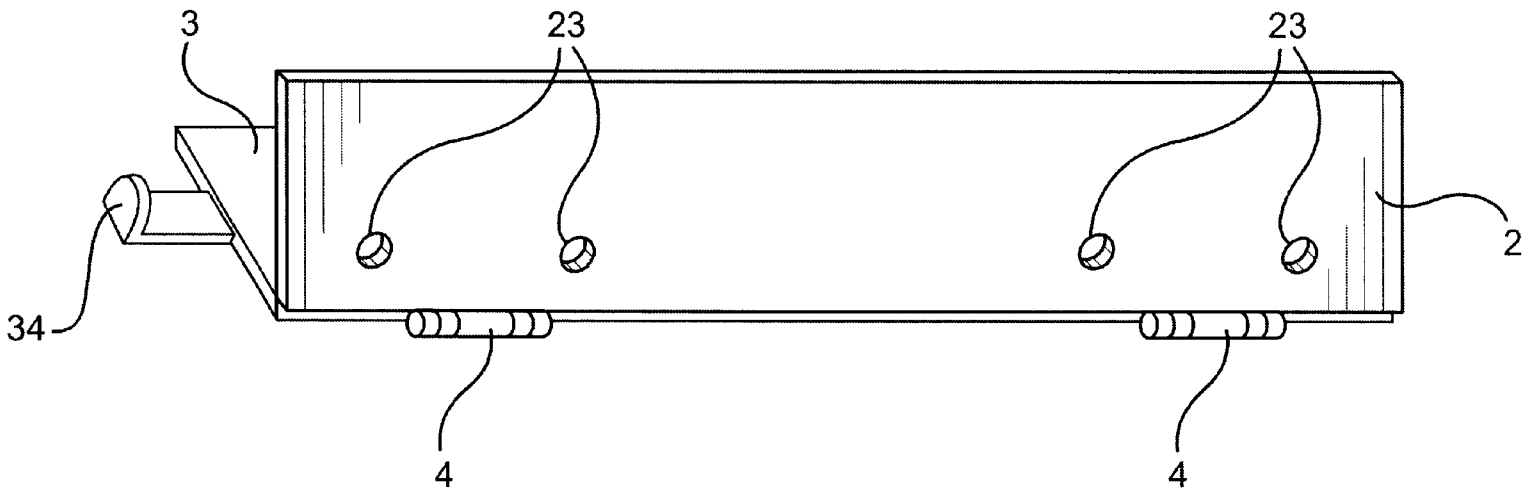
FIG. 2 is another perspective view of the device of FIG. 1.
Figure 3:
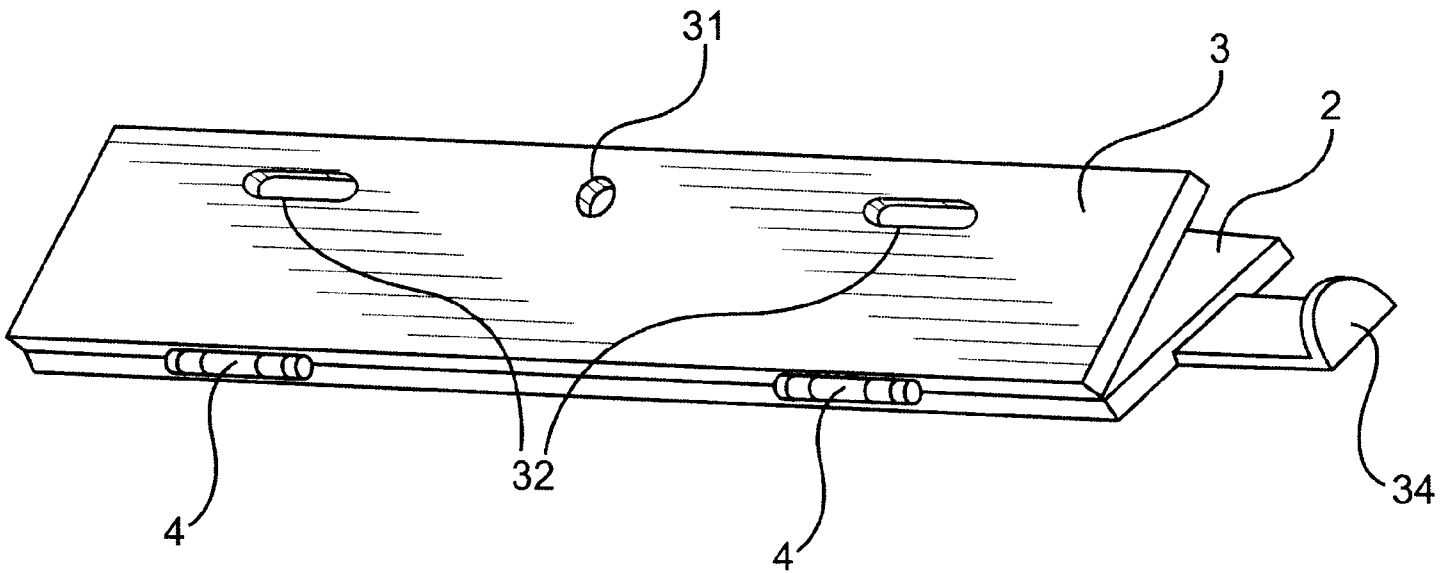
FIG. 3 is a further perspective view of the device of FIGS. 1 and 2.

Referring to the drawings and initially to FIGS. 1 to 3 there is shown a first embodiment of a device in accordance with the invention indicated generally by the reference numeral 1. The device 1 has a punching plate 2 connected to a receiving plate 3 by hinges 4.

In more detail, the punching plate 2 has an upwardly extending circular punch 21 located intermediate and coaxial with two upwardly extending rectangular punches 22 and four alignment receiving apertures 23. The receiving plate 3 in turn has a circular recess 31 located intermediate and coaxial with two rectangular recesses 32 and four upwardly extending paper guides 33. The receiving plate 3 also has a dimension guide 34.

Figure 4:
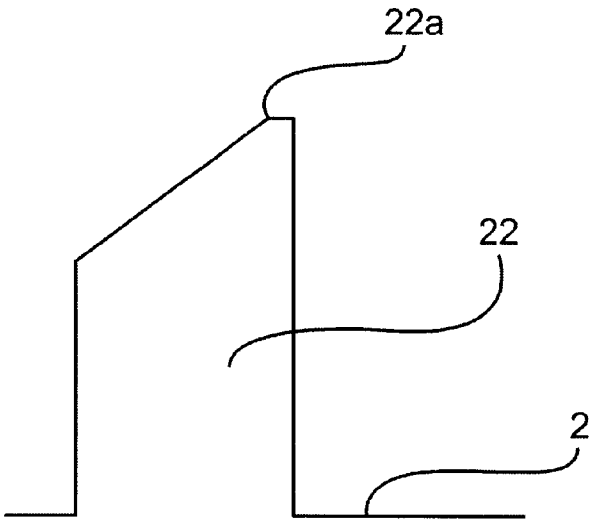
FIG. 4 is a side view of a rectangular punch forming part of the device.
Figure 5:
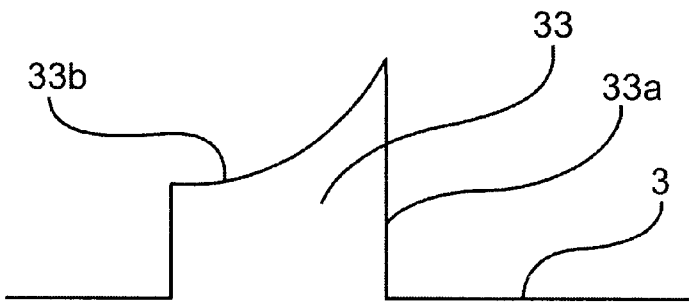
FIG. 5 is a side view of a paper guide forming part of the device in accordance with the invention.

Referring now to FIG. 4 each of the rectangular punches 22 has an angled cutting edge 22*a* tapering toward the hinges 4.

The paper guides 33 have an abutment edge 33*a* and an angled top profile 33*b* again tapering toward the hinges 4.

In use, a sheet of animation paper (not shown) is positioned on the receiving plate 3 so that an edge of the paper abuts against the abutment edges 33*a* of the paper guides 33. With the paper in position, the punching plate 2 is moved on the hinges 4 toward the receiving plate 3. When the punching plate 2 is positioned over the paper and the receiving plate 3, the circular punch 21 is a small arc away from being directly above the circular recess 31. Similarly the two upwardly extending rectangular punches 22 and four alignment receiving apertures 23 are almost directly above the two rectangular recesses 32 and four upwardly extending paper guides 33 respectively. Further pivotal movement of the punching plate 2 toward the receiving plate 3 about the hinges 4 causes the punches 21 and 22 to pass through the paper and into their respective recesses 21 and 32. As the rectangular punches 22 have an angled cutting edge 22*a* tapering toward the hinges 4 contact between the punches 22 and the recesses 32 is avoided thereby allowing tight tolerances to be achieved. In the same way, the angled top profiles 33*b* prevent unnecessary contact with the apertures 23.

To ensure that the registration holes are created by the punch device in the same general location on each successive sheet the dimension guide 24 is used. This guide can be repositioned to accommodate a variety of paper sizes.

Figure 6:
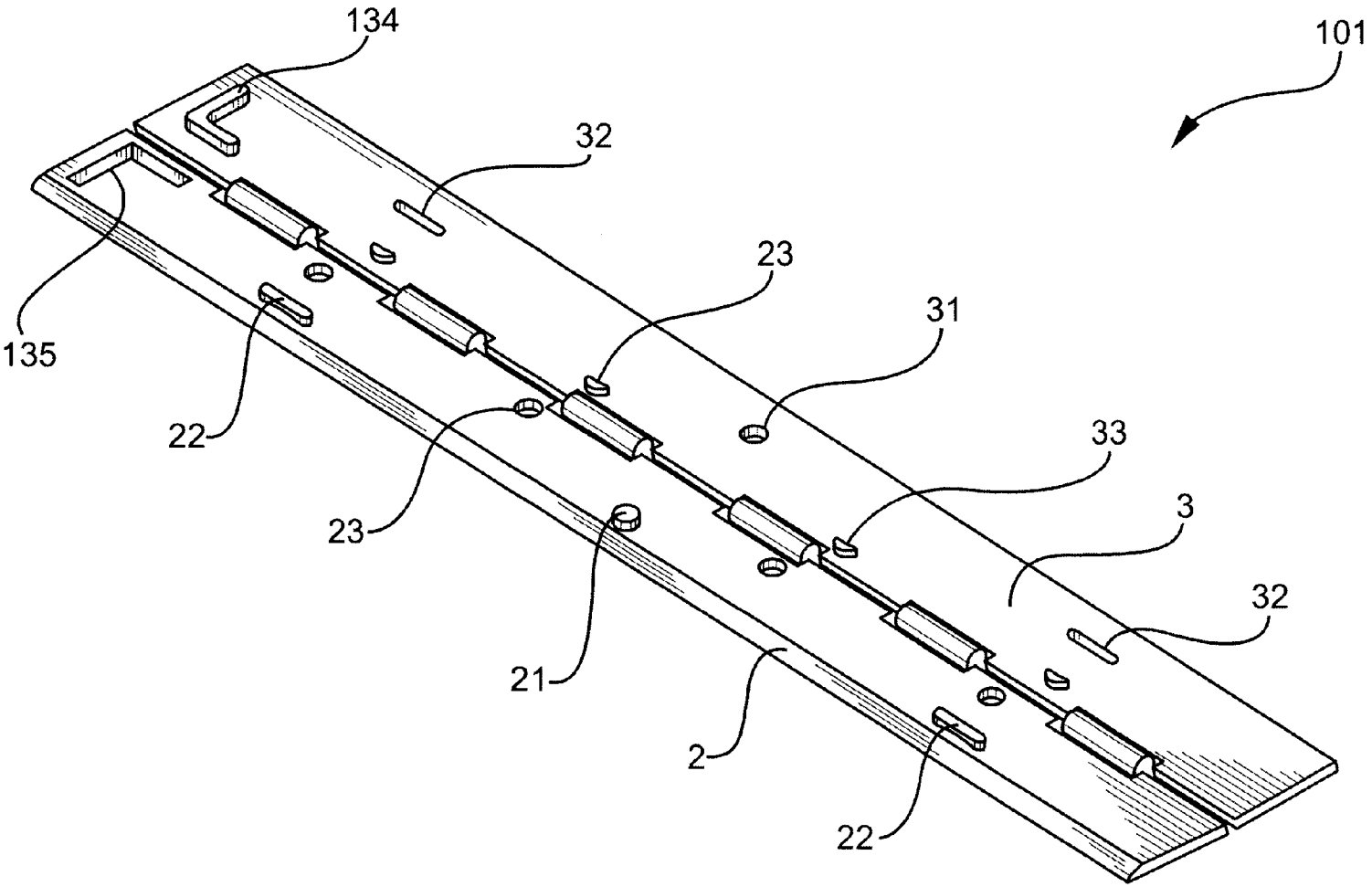
FIG. 6 is a perspective view of a second embodiment of a device in accordance with the invention.
Figure 7:
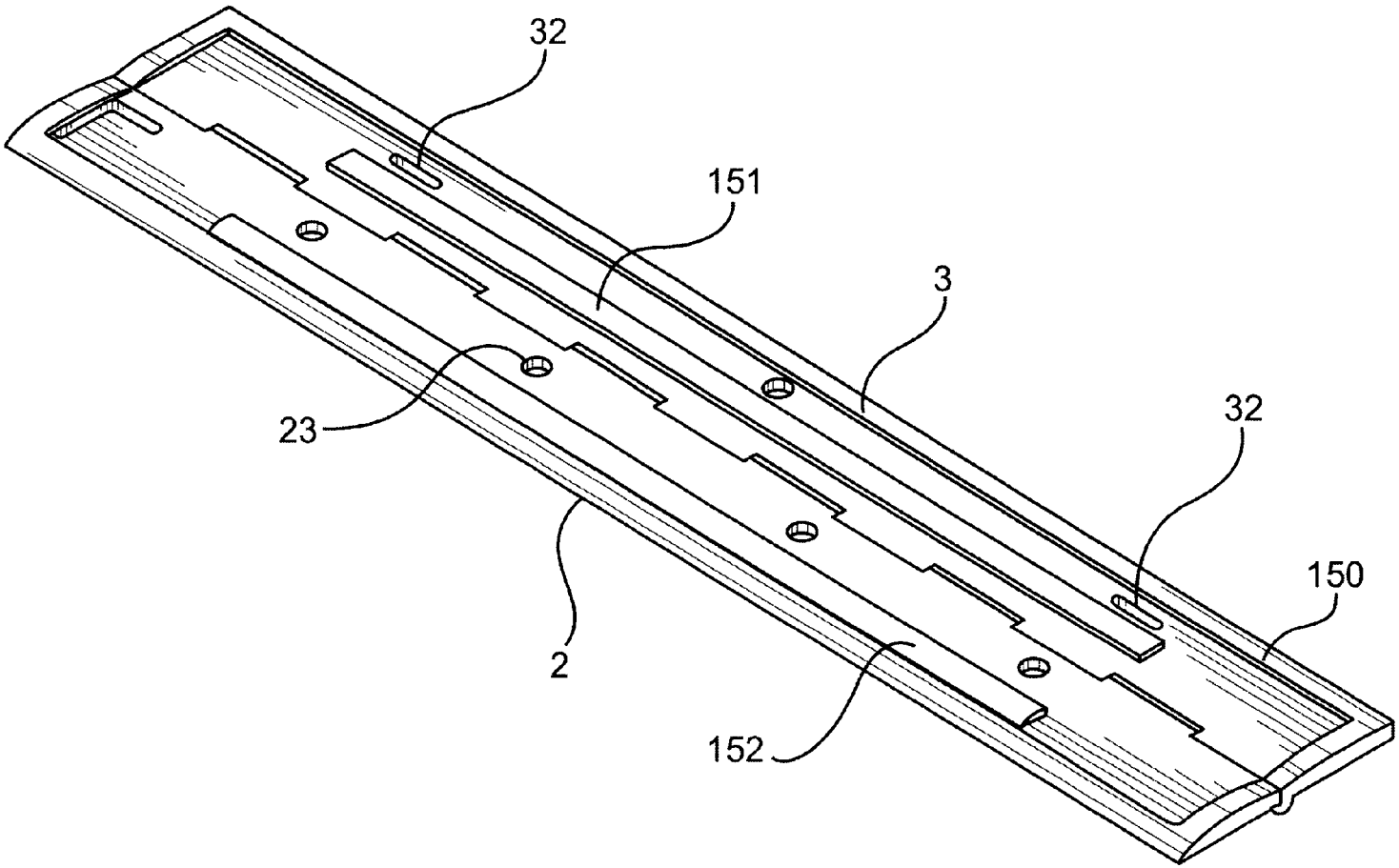
FIG. 7 is a reverse perspective view of the second embodiment.

The second embodiment 101 shown in FIGS. 6 and 7 is broadly similar to the first embodiment 1 shown in FIGS. 1 and 3. Built into the receiving plate 3 of the second embodiment 101 is an L-shaped corner stop 134 against which a corner of a sheet of paper is located prior to the punching operation commencing. A correspondingly L-shaped recess

135 is provided on the punching plate 2. Outer ridges 150 and inner strips 151 and 152 assist in maintaining the device straight and prevent buckling after the device has been formed by injection moulding.

It will be understood that the provision of a device in this way allows for the provision of a portable animation paper punch. This solves the problems of heavy and expensive equipment, which is not widely available. Furthermore, difficulties associated with insufficient supplies are obviated by the relatively simple expedient of punching individual additional sheets as may be required.

As the punching device can be manufactured from a lightweight inexpensive plastics material personal paper punches may be provided. This is particularly attractive for the provision of student punches thereby overcoming the term end bottleneck around known punching machines. A thermosetting plastics material is the preferred material for the device.

It will of course be understood that the invention is not limited to the specific details as herein described, which are given by way of example only, and that various alterations and modifications may be made without departing from the scope of the invention as defined in the claims.

What is claimed is:

1. An animation page registration hole punch for use in the preparation of animation paper comprising:

a injection molded punching plate, said punching plate having at least one upwardly extending circular punch and at least two upwardly extending rectangular punches, said punches positioned a predetermined distance from each other, said punching plate having an "L" shaped recess adjacent said punches; and an injection molded receiving plate hingedly connected to said punching plate, said receiving plate having at least one circular receiving hole positioned to correspond with said circular punch and at least two rectangular receiving holes positioned to correspond to said rectangular punches and a raised "L" shaped guide extending from said receiving plate corresponding to said "L" shaped recess.

2. A device as claimed in claim 1, in which the receiving plate incorporates and upwardly extending paper guide formed for complimentary engagement with an aperture on the punching plate.

3. A device as claimed in claim 1, in which the receiving plate incorporates a dimension guide.

4. A device as claimed in claim 1, in which each rectangular punch has an angled cutting edge, thereby preventing undue contact between the punching plate and the receiving plate and allowing tighter tolerances to be achieved so as to guarantee registration between respective sheets of a given animation page.

5. A device as claimed in claim 2, in which the paper guide has an abutment edge and an angled top profile.

6. An animation page registration hole punch as claimed in claim 1, wherein said punching plate and said receiving plate is made of a thermosetting plastic.

7. An animation page registration hole punch as claimed in claim 1, wherein said raised "L" shaped guide and said at least one circular punch and at least two rectangular punches are positioned on said animation page registration hole punch to punch holes that are centered on a standard animation sheet of paper.

8. An animation page registration hole punch as claimed in claim 1, wherein there are two raised rectangular shaped punches each having a curved edge and wherein said two rectangular punches and said one circular punch are positioned to create a plurality of holes that corresponds with a standard sheet of animation paper.

9. A device as claimed in claim 1, in which the receiving plate is provided with a corner stop.

* * * * *